United States Patent [19]

Larking

[11] Patent Number: 4,460,222

[45] Date of Patent: Jul. 17, 1984

[54] DRAWER APPARATUS

[76] Inventor: Alfred E. R. Larking, 15 Lambton Rd., London, N.19, England

[21] Appl. No.: 406,912

[22] Filed: Aug. 10, 1982

[30] Foreign Application Priority Data

Aug. 11, 1981 [GB] United Kingdom ..... 8124492

[51] Int. Cl.[3] ..... A47B 81/00

[52] U.S. Cl. ..... 312/286; 312/222; 312/330 R

[58] Field of Search ..... 312/222, 283, 286, 330 R; 292/202, 251.5; 232/43.4

[56] References Cited

U.S. PATENT DOCUMENTS

| | | | |
|---|---|---|---|
| 2,199,881 | 5/1940 | Hedlund | 312/222 |
| 3,016,563 | 1/1962 | De Jong | 292/251.5 |
| 3,547,506 | 12/1970 | Larking | 312/286 X |
| 4,054,308 | 10/1977 | Prohaska | 292/DIG. 46 |

FOREIGN PATENT DOCUMENTS

| | | | |
|---|---|---|---|
| 2056775 | 3/1972 | Fed. Rep. of Germany | 312/283 |

*Primary Examiner*—William E. Lyddane
*Assistant Examiner*—Joseph Falk
*Attorney, Agent, or Firm*—Cushman, Darby & Cushman

[57] ABSTRACT

The wall between the interior and exterior of a premises such as a house is provided with an aperture in which there is slidingly received a security or anti-theft drawer having two "fronts" so it can be pulled out to open it from outside the premises and pulled in to open it from inside the premises, so that pick-ups and deliveries of items may be made without requiring a face-to-face exchange. The drawer apparatus is provided with a lock mechanism which is settable by the inside person so as to permit the delivery person to pull out the drawer only once. After the drawer is closed it cannot be pulled out again until it is reset by the inside person. Further, the lock mechanism is controllable by the inside person to prevent the drawer from being opened inwards even once until the inside person manipulates a control for the lock mechanism. Structural variations of the lock mechanism are disclosed.

15 Claims, 5 Drawing Figures

FIG. 1
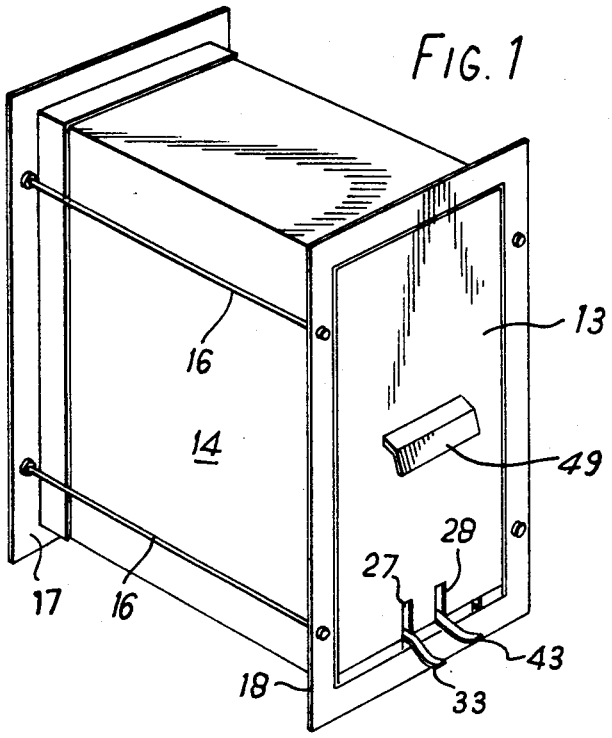
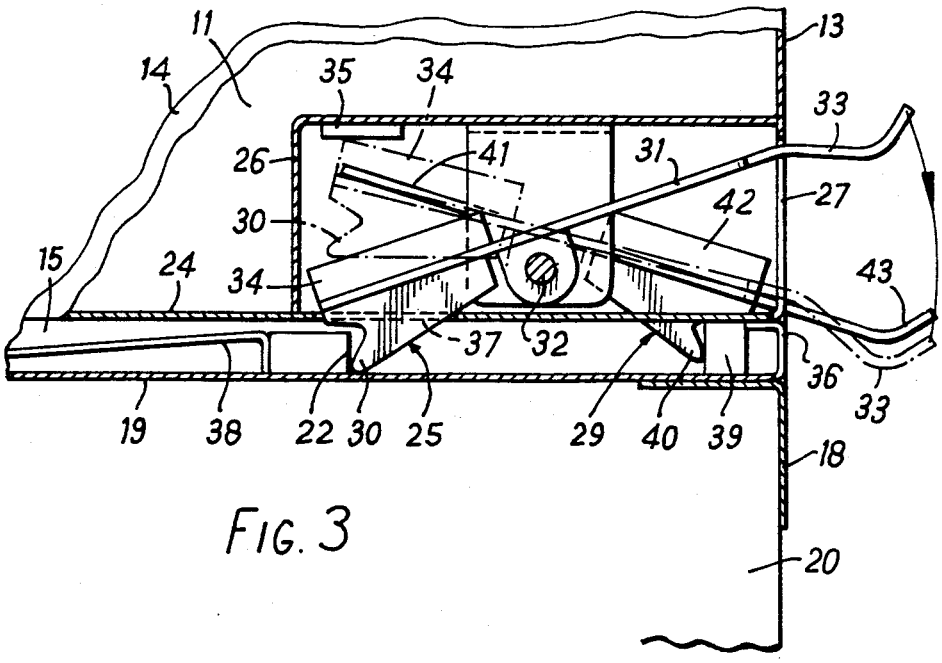
FIG. 3

DRAWER APPARATUS

This invention relates to drawer apparatus and in particular to a security or anti-theft drawer apparatus (hereinafter called "of the kind specified") comprising a drawer for mounting in an aperture from which the drawer is selectively withdrawable in either of two opposite directions, withdrawal (i.e. opening) of the drawer in one direction followed by drawer closure in the opposite direction automatically preventing re-opening of the drawer in said one direction.

Figure 2:
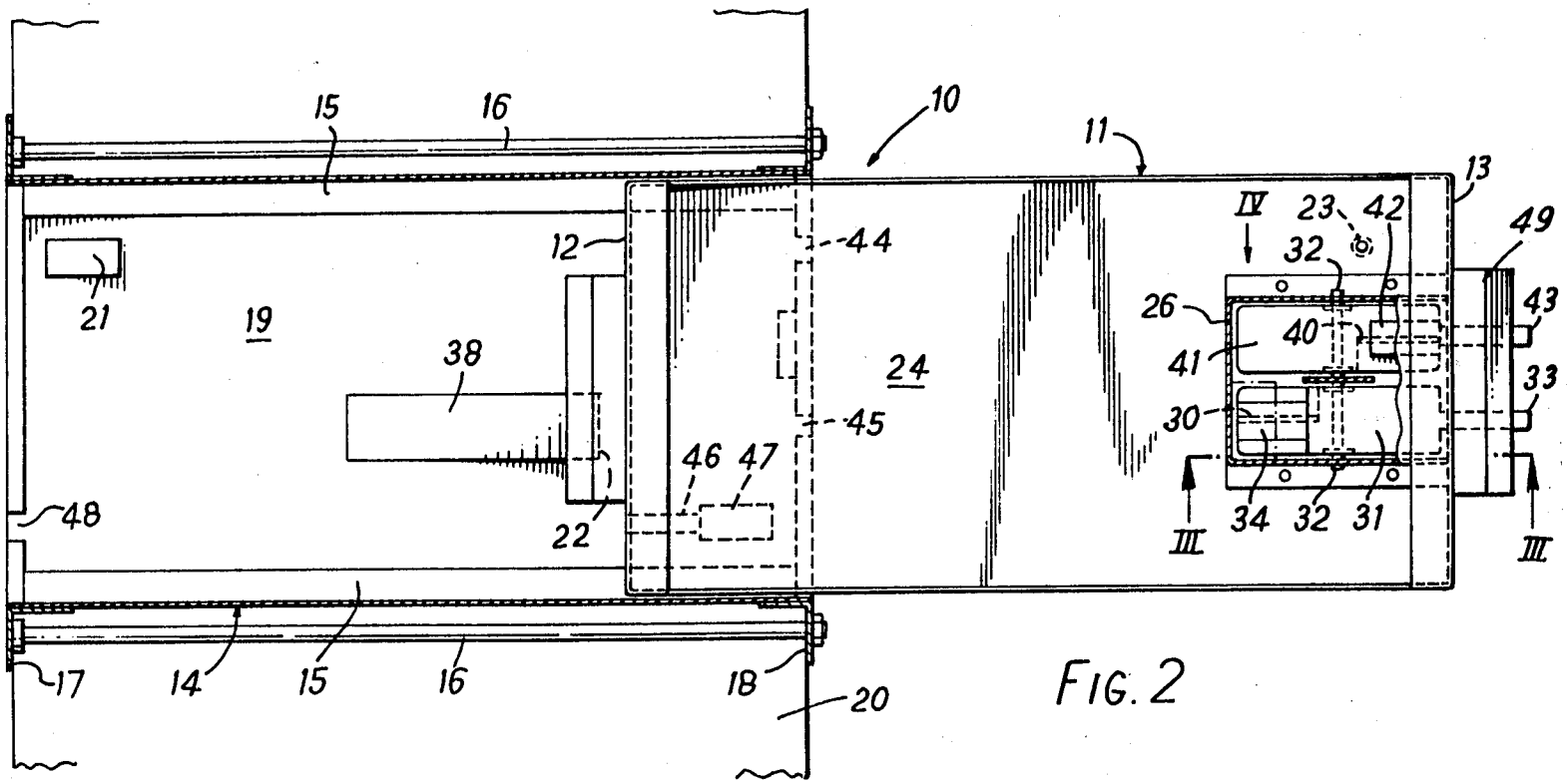
Figure 4:
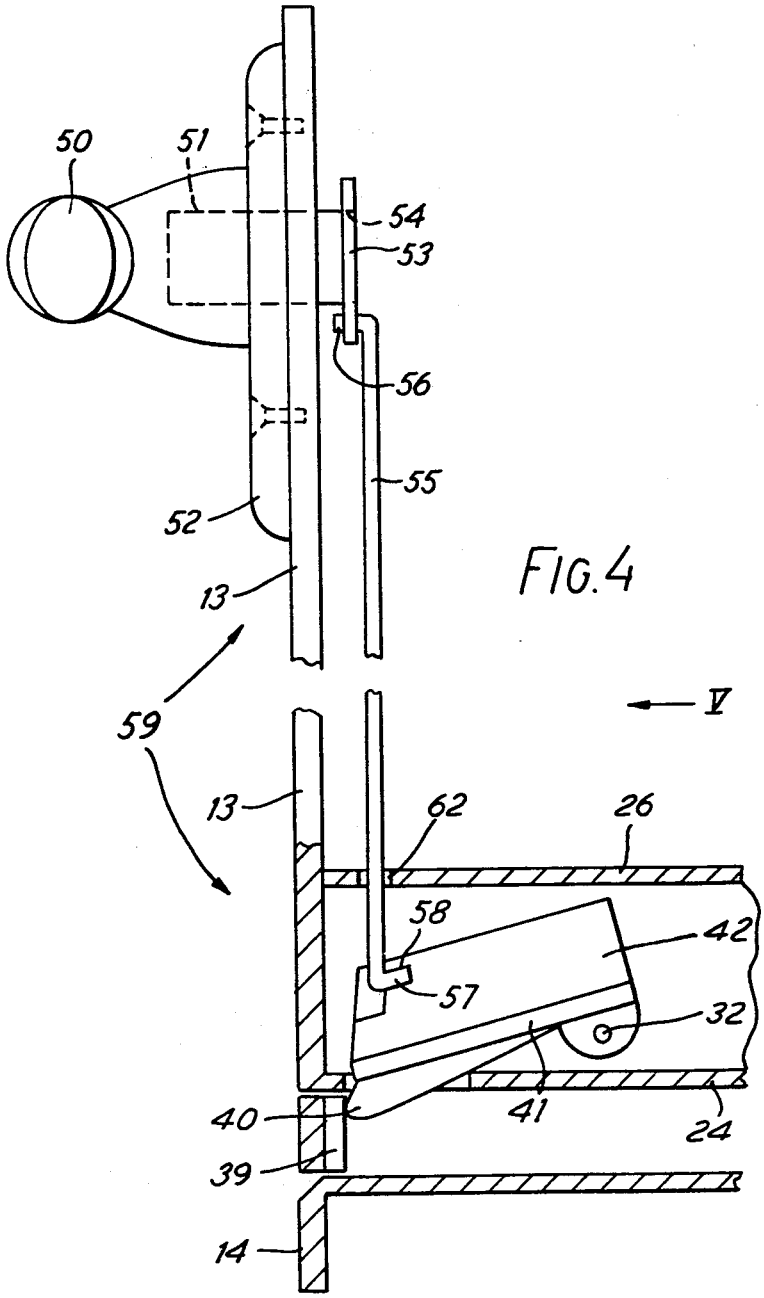

This kind of security or anti-theft drawer is known from, for example, U.K. Pat. No. 1,194,417 and U.S. Pat. No. 3,547,506 corresponding thereto, the drawer in use being for example mounted in an aperture in a wall or door such that one drawer "front" faces the building exterior in said one direction and the opposite drawer "front" faces the building interior in the said opposite direction. The therein-described and illustrated drawers include complicated locking and release mechanisms occupying considerable space within the drawer. In the embodiment of FIGS. 1 and 2 thereof, these mechanisms are located within the drawer adjacent the exterior-facing drawer "front" such that the operative mechanisms are potentially accessible from outside the building and might be tampered with (following said initial opening in said one direction). However the locking mechanism to prevent re-opening is triggered shortly after the onset of the initial first opening of the drawer in said one direction. In the embodiment of FIGS. 3 and 4 thereof, the mechanisms are located within the drawer in a more tamper-proof position adjacent the interior-facing drawer "front" but, in this case, the locking mechanism to prevent re-opening is only triggered if the drawer is virtually fully withdrawn outwards upon initial first opening of the drawer. If the drawer is only partially opened in said one direction the locking mechanism is not triggered and following drawer closure it may be re-opened in said one direction.

With either of the aforesaid embodiments, resetting of the locking means from the operative to inoperative condition is effected automatically upon withdrawal of the drawer in the other, opposite direction and reclosing the drawer in said one direction. It is now deemed of greater advantage to be able to effect such resetting manually and without opening and reclosing the drawer, i.e. even whilst the drawer is closed.

It will thus be apparent that it is desirable to provide a security or anti-theft drawer apparatus of the kind specified wherein, in contrast with the prior art, the locking/release mechanisms (a) occupy little space, (b) are located in a position rendering tampering difficult, if not impossible, (c) are triggered immediately after the onset of initial first opening of the drawer in said one direction to prevent subsequent re-opening in said one direction, and (d) may be manually reset (to permit such re-opening) with the drawer remaining closed.

According to one aspect of this invention there is provided a security or anti-theft drawer apparatus comprising a drawer having two opposite drawer "fronts" and arranged for mounting in an aperture from which it may be selectively withdrawn in either of the two opposite directions faced by said drawer fronts, and locking means having an operative condition in which the locking means prevent withdrawal of the drawer in one direction from a closed position and an inoperative condition in which drawer withdrawal in said one direction is unimpeded by said locking means, said locking means being located predominantly within the drawer adjacent the one drawer front that is trailing when the drawer is opened in said one direction and including a control member co-operable with a defining surface of the aperture for automatically triggering the inoperative locking means upon opening the drawer in said one direction from a closed position such that upon reclosing the drawer the locking means adopts its operative condition to prevent a re-opening of the drawer in said one direction, characterised in that said control member projects from said one drawer front outwardly of the drawer such as to render the locking means manually settable to either its operative or inoperative condition whilst said drawer is closed.

Preferably said control member comprises a lever pivoted intermediate its ends of which one projects outwardly of the drawer as aforesaid and the other is provided with a latch for engagement, in the operative condition of the locking means, with a stop member fast with a defining surface of the aperture.

Advantageously said other end of the lever is selectively holdable by permanent magnet means such that, in the inoperative condition of the locking means, said latch is retained by the permanent magnet means out of engagement of the stop member.

According to another aspect of this invention there is provided a security or anti-theft drawer apparatus comprising a drawer having two opposite drawer "fronts" and arranged for mounting in an aperture from which it may be selectively withdrawn in either of the two opposite directions faced by said drawer fronts, and locking means having an operative condition in which the locking means prevent withdrawal of the drawer in one direction from a closed position and an inoperative condition in which drawer withdrawal in said one direction is unimpeded by said locking means, said locking means being located predominantly within the drawer adjacent the one drawer front that is trailing when the drawer is opened in said one direction and including a control member co-operable with a defining surface of the aperture for automatically triggering the inoperative locking means upon opening the drawer in said one direction from a closed position such that upon reclosing the drawer the locking means adopts its operative condition to prevent a re-opening of the drawer in said one direction, characterised in that said control member projects from said one drawer front outwardly of the drawer such as to render the locking means manually settable to either its operative or inoperative condition whilst said drawer is closed, said control member comprises a lever pivoted intermediate its ends of which one projects outwardly of the drawer as aforesaid and the other is provided with a latch for engagement, in the operative condition of the locking means, with a stop member fast with a defining surface of the aperture, and in that said other end of the lever is selectively holdable by permanent magnet means such that in the inoperative condition of the locking means, said latch is retained by said magnet means out of engagement of the stop member.

Advantageously said permanent magnet means comprise a magnetic retainer member fast with a housing (within the drawer) for the locking means, a magnetic iron member engageable with the magnetic retainer member being fast with said other end of the lever.

Conveniently said magnetic iron member at said other end of the lever constitutes or is associated with a counterweight in use to assist the gravitational downward urging of the latch out of magnetic retention by said magnetic retainer member.

Preferably further locking means are provided having an operative condition in which the further locking means prevent withdrawal of the drawer in the other, opposite direction from a closed position and an inoperative condition in which drawer withdrawal in said other direction is unimpeded by said further locking means.

Conveniently said further locking means is located predominantly within the drawer adjacent said one drawer front, e.g. in said housing for the first-mentioned locking means.

Advantageously said further locking means includes a control member projecting from said one drawer front outwardly of the drawer such as to render the further locking means manually settable to either its operative or inoperative condition whilst said drawer is closed. In one embodiment of this invention said control member of the further locking means preferably comprises a lever pivoted intermediate its ends of which one projects outwardly of the drawer as aforesaid and, between said projecting end and the pivot, carries a latch for engagement (in the operative condition of the further locking means) with a stop member fast with a defining surface of the aperture.

In an alternative embodiment of this invention said control member of the further locking means comprises an angularly movable handle mounted on the outer surface of said one drawer front, the handle being operatively connected internally of the drawer and via a link member to a pivoted lever that carries a latch for engagement (in the operative condition of the further locking means) with a stop member fast with a defining surface of the aperture.

Figure 5:
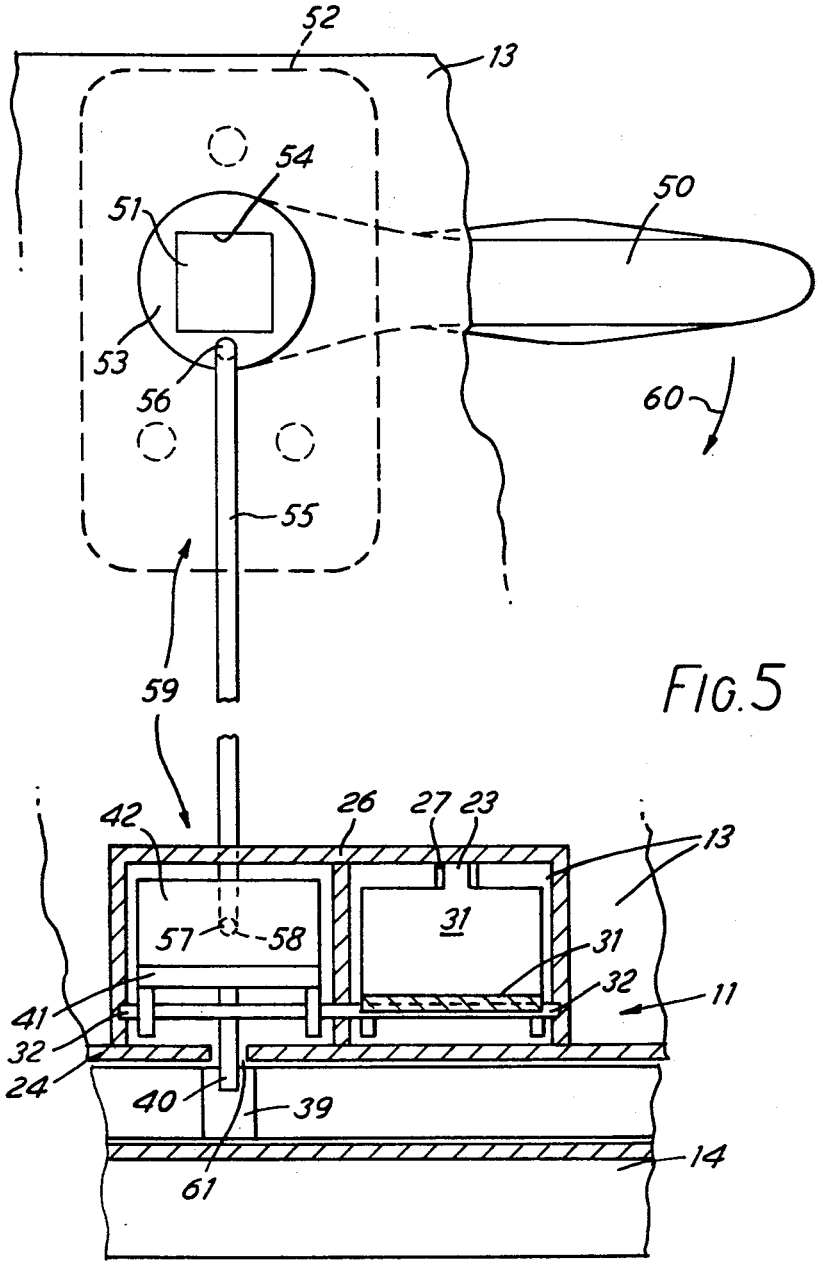

By way of non-limiting example, embodiments of this invention will now be described with reference to the accompanying drawings of which FIG. 1 is a schematic perspective view of drawer apparatus according to a first embodiment of this invention and the means for mounting it in a boundary wall of domestic premises, FIG. 2 is a partly-sectioned plan view of the drawer apparatus of FIG. 1 mounted in said boundary wall with the drawer partially opened to the interior of said premises, FIG. 3 is an enlarged cross-sectional view along the line III—III of FIG. 2 with the drawer closed and locked against withdrawal in both directions, FIG. 4 is a schematic cross-sectional view through part of drawer apparatus according to a second embodiment of this invention, this view corresponding to a view in the direction of arrow IV in FIG. 2, and FIG. 5 is a view in the direction of arrow V in FIG. 4.

The drawer apparatus 10 illustrated in FIGS. 1–3 comprises a drawer 11 formed of sheet metal with an external height and depth each of about 30 cm and a width across its two opposite drawer front panels 12, 13 of about 15 cm. An alternative form of the drawer apparatus (not shown) may have its drawer 11 with a width of about 30 cm. The drawer 11 is slidable (in the direction of its depth transversely of the two opposite drawer front panels 12, 13) into and out of an aperture defined by the walls of a parallelepiped shell 14 formed of sheet metal, the drawer 11 riding on lateral runners 15 at the sides of the shell 14 and slightly upstanding from the shell's bottom wall 19. The shell 14 is in use mounted in a wall or door 20 forming part of the boundary of domestic or other premises. Such mounting is by means of tie bolts 16 extending between flanges 17, 18 encompassing the ends of the shell to each side of the wall or door 20, flange 17 being fast with shell 14 and flange 18 being movable therealong. The aperture defined by the walls of the shell 14 extend through the wall or door 20, the drawer front panel 12 facing the exterior of the premises and the drawer front panel 13 facing the interior of the premises. The bottom wall 19 of the shell 14 is provided with positionally fixed stop members 21, 22 spaced apart longitudinally of the shell's length dimension (equivalent to the depth dimension of the drawer) and also spaced apart laterally in the width dimension of the shell (and drawer). The stop member 21 is longitudinally aligned with a stop member 23 depending from the base 24 of the drawer 11 adjacent the latter's drawer front panel 13. Thus engagement of stop members 21, 23 prevents the drawer 11 being pulled right out of the shell 14 from the exterior of the premises. Stop member 22 is releasably engageable by the latch of a locking mechanism 25 which, when operative, prevents the drawer 11 being withdrawn at all, i.e. opened, from the exterior of the premises.

The locking mechanism 25 is located predominantly within a housing 26 disposed within the drawer 11 adjacent the latter's interior-facing front wall 13. The housing 26 is approximately 8 cm long (in the drawer's depth dimension), 6 cm wide and 3 cm high, the portion of the housing formed by the drawer's front wall 13 being provided with two vertical slots 27, 28. The slot 27 is associated with locking mechanism 25 and the slot 28 is associated with another mechanism 29 (to be described below) that is also located predominantly within the same housing 26 as locking mechanism 25.

The locking mechanism 25 comprises a V-shaped latch 30 secured at the underside of one end of a lever 31 that extends longitudinally of the housing 26. The lever 31 is pivoted intermediate its ends on a transverse pivot pin 32 extending between the side walls of housing 26. The other end 33 of lever 31 is of reduced width and extends outwardly of housing 26 and drawer 11 through the slot 27. Said one end of the lever 31 is weighted by an iron member 34 secured thereto above the latch 30 and co-operable magnetically with a permanent magnet member 35 secured to the underside of the roof of housing 26. When the locking mechanism 25 is in its inoperative state the latch 30 is retained upwards by the magnetic coupling (and physical contact) between permanent magnet member 35 and iron member 34, the lever end 33 depending angularly downwards therefrom to a level below that of the interior-facing edge or lip 36 of the aperture-defining shell 14. When the locking mechanism is in its operative state, the latch 30 is in a downwards position where it projects through a slot 37 in the base 24 of drawer 11 and is engageable with the stop member 22. The locking mechanism is automatically released from its inoperative condition by opening of the drawer from the exterior of the premises since, virtually immediately upon initiation of such outward opening motion, the depending end 32 of lever 31 engages and effects a camming action against the interior edge or lip 36 of the aperture-defining shell 14 whereby that lever end 32 is forced to rise and cause iron member 34 to move away from and out of the magnetic retention effect of the permanent magnet member 35. The iron member 34 then acts as a weight or counterweight to gravitationally urge the latch 30 downwards through slot 37 into engagement of a ramp 38 leading from the top of stop member 22 downwards as it extends towards the exterior (the drawer's slot 37 having moved outwards past the top of stop member 22).

The drawer 11 may then continue uneventfully its full outwards opening motion until stop members 21 and 23 engage to prevent total withdrawal of the drawer 11 out of the aperture. In use any articles to be delivered (e.g. mail, parcels, bread, milk, eggs) can be inserted in the outwardly open drawer 11 which may then be closed. Upon such closing the released latch 30 rides up the ramp 38 until it passes the stop member 22 and, under the weight-assisted gravitational effect of iron member 34, it automatically drops down behind the stop member 22, providing a non-resilient positive latching action to prevent re-opening of the drawer from the exterior. Such re-opening can only be achieved by manually resetting the locking mechanism 25 to its inoperative condition (wherein latch 30 is retained in its upward position by the magnetic coupling of members 34 and 35), this being achieved from the interior of the premises by merely depressing raised lever end 33 which projects through the drawer front 13.

The releasable locking mechanism 29 of FIGS. 1–3 has an operative state in which it serves to prevent withdrawal of the drawer 11 inwardly of the premises, and an inoperative state in which such withdrawal and drawer opening (to remove any articles deposited therein from the exterior) is permitted. The locking mechanism 29 comprises a V-shaped latch 40 engageable with a stop member 39 that is fixed to the bottom wall 19 of the shell 14. The latch 40 is secured to the underside of a lever 41 extending longitudinally of housing 26 and pivoted intermediate its ends on the same pivot pin 32 as lever 31. The latch 40 is located along the lever 41 between the pivot pin 32 and the drawer front 13 and is surmounted by a weight 42 that serves to urge the latch 40 by gravity downwards through a slot (not shown) in the base 24 of the drawer 11 into the operative state of locking mechanism 29. The adjacent end 43 of lever 41 is of reduced width and projects outwardly of housing 26 and drawer 11 through the slot 28. To release the locking mechanism 29 from its operative to its inoperative state, it is necessary merely to raise lever end 43 manually from inside the premises (and thereby raise latch 40 out of engagement of stop member 39) and pull the drawer 11 inwardly of the premises by handle 49.

A slot 44 is provided in the lip 36 in alignment with stop members 21 and 23 to permit the pasage therethrough of stop member 23 when the drawer is opened inwardly. Another slot 45 is provided in the lip 36 in alignment with latch 30 to permit the passage therethrough of latch 30 when the drawer is opened. Two further aligned stop members 46, 47 are provided to prevent total withdrawal of the drawer 11 from the shell 14 when the drawer is opened to the interior of the premises, the stop member 46 depending from the underside of the drawer's base 24 adjacent the drawer's front face 12 and the stop member 47 projecting upwardly from the bottom wall 19 of the shell 14.

In the modified embodiment of this invention schematically illustrated in FIGS. 4 and 5, the releasable locking mechanism 29 of FIGS. 1–3 is replaced by a handle-operated locking mechanism 59. The latter comprises the same elements and members as the above-described locking mechanism 29 save that the drawer front has no slot 28 and the lever 41 has no end 43 projecting outwardly of housing 26 and drawer 11. Instead, a link member 55 extends through a slot 62 in the roof of housing 26 and is connected to a rotatable-type handle 50 that can be angularly moved through a quarter turn (i.e. 90°) about its axis. This handle 50 replaces the pull-type interior handle or grip 49 shown in FIGS. 1 and 2. The handle 50 is of a generally conventional kind provided with a square-section stub shaft 51 and with an escutcheon plate 52 by means of which handle 50 is screw-mounted on the interior-facing surface of drawer front 13, the stub shaft 51 projecting through drawer front 13 inwardly of the drawer. For the locking mechanism 59 a plate 53 provided with a square-section hole 54 is fitted onto stub shaft 51. The two ends 56, 57 of link member 55 are bent over to be directed in opposite directions, upper end 56 being connected to the plate 53 at a location below the axis of stub shaft 51, lower end 57 being connected to the remainder of locking mechanism 59, e.g. by being introduced into an aperture 58 provided in the upstanding end face of counterweight 42. Ideally, the connection of end 56 or 57 is such as to permit lost motion between link member 55 and plate 53 or between link member 55 and the said remainder of the locking mechanism 59, whereby upwards pivotal motion of the mechanism about pivot pin 32 does not cause a rotation of handle 50 (in a direction opposite to arrow 60 of FIG. 5). Advantageously, parts 53–56 are disposed within an upstanding U-section extension (not shown) of housing 26, the drawer front 13 being engaged by the limbs of the U.

The locking mechanism 59 is in its operative state when the handle 50 is in the position shown in FIG. 5. In this position, gravity, acting on the weight 42 surmounting lever 41 and latch 40, urges latch 40 downwardly through the slot 61 in the base 24 of drawer 11 and into the position in which it can engage stop member 39 (see FIG. 4). To release the locking mechanism 59 from its operative to its inoperative state from inside the premises, the handle 50 is rotated clockwise through a quarter turn (as indicated by the arrow 60 in FIG. 5) whereby link member 55 is, in effect, raised such as to pivot weight 42, lever 41 and latch 40 about pivot pin 32 and lift latch 40 out of engagement of stop member 39. The same handle 50 is then pulled to pull the drawer 11 inwardly of the premises.

It will be appreciated that by providing for locking mechanism 59 to be releasable by a rotatable handle that also serves for pulling on the drawer to withdraw it from the shell 14 inwardly of the premises, the embodiment of FIGS. 4 and 5 allows for easier use by elderly and/or disabled persons.

From the foregoing it will be appreciated that the two locking mechanisms 25 and 29 of FIGS. 1–3, or 25 and 59 of FIGS. 4 and 5, are independent of one another and each is manually operable to its inoperative condition, the locking mechanism 25 being automatically triggered immediately upon initiating drawer withdrawal in the exterior-facing direction (i.e. outwards opening), said triggering of the locking mechanism 25 being from its inoperative condition and such as to cause it to obtain its operative condition automatically upon reclosing the drawer (and thereby prevent outwards re-opening) even if the drawer was initially only partially opened.

A plurality of illustrated drawer apparatuses 10 may be placed together in a regular array, in a panel or wall, at the entrance to a multi-occupancy block, e.g. an office block or a block of apartments. Advantageously in such cirumstances each locking mechanism 29 or 59 may be a separate key-operable mechanism controlling operation of the associated latch 40. With mechanism 59 the key may be used to lock either handle 50 or link member 55 against movement.

In another possible modification of the illustrated drawer apparatus, the walls of the housing 26 may be of magnetisable material and the permanent magnet means 35 may be constituted by the iron member 34 so that the magnetic coupling to render locking mechanism 25 inoperative is established directly between the iron member 34 and the magnetisable roof of the housing 26.

In still another possible modification the iron member 34 may be laterally beside one or more separate non-magnetic counterweights (as shown schematically in FIG. 2).

I claim:

1. A security or anti-theft drawer apparatus comprising a drawer having two opposite drawer "fronts" and arranged for mounting in an aperture from which it may be selectively withdrawn in either of the two opposite directions faced by said drawer fronts, and locking means having an operative condition in which the locking means provide a non-resilient positive latching action to prevent withdrawal of the drawer in one direction from a closed position and an inoperative condition in which drawer withdrawal in said one direction is unimpeded by said locking means, said locking means being located predominantly within the drawer adjacent the one drawer front that is trailing when the drawer is opened in said one direction and including a control member co-operable with a defining surface of the aperture for automatically triggering the inoperative locking means upon opening the drawer in said one direction from a closed position such that upon reclosing the drawer the locking means adopts its operative condition to prevent a re-opening of the drawer in said one direction, characterised in that said control member projects from said one drawer front outwardly of the drawer such as to render the locking means manually settable to either its operative or inoperative condition whilst said drawer is closed.

2. Drawer apparatus according to claim 1, wherein, said control member comprises a lever pivoted intermediate its ends of which one projects outwardly of the drawer as aforesaid and the other is provided with a latch for engagement, in the operative condition of the locking means, with a stop member fast with a defining surface of the aperture.

3. Drawer apparatus according to claim 2, wherein said other end of the lever is selectively holdable, by permanent magnet means such that in the inoperative condition of the locking means, said latch is retained by said permanent magnet means out of engagement of the stop member.

4. Drawer apparatus according to claim 3, wherein said permanent magnet means comprise a magnetic retainer member fast with a housing (within the drawer) for the locking means, a magnetic iron member engageable with the magnetic retainer member being fast with said other end of the lever.

5. Drawer apparatus according to claim 4, wherein said magnetic iron member at said other end of the lever constitutes or is associated with a counterweight in use to assist the gravitational downward urging of the latch out of magnetic retention by said magnetic retainer member.

6. Drawer apparatus according to claim 1, wherein further locking means are provided having an operative condition in which the further locking means prevent withdrawal of the drawer in the other, opposite direction from a closed position and an inoperative condition in which drawer withdrawal in said other direction is unimpeded by said further locking means.

7. Drawer apparatus according to claim 6, wherein said further locking means is located predominantly within the drawer adjacent said one drawer front.

8. Drawer apparatus according to claim 5, wherein further locking means is located predominantly in said housing for the first-mentioned locking means, said further locking means having an operative condition in which the further locking means prevent withdrawal of the drawer in the other, opposite direction from a closed position and an inoperative condition in which drawer withdrawal in said other direction is unimpeded by said further locking means.

9. Drawer apparatus according to claim 6, wherein said further locking means includes a control member projecting from said one drawer front outwardly of the drawer such as to render the further locking means manually settable to either its operative or inoperative condition whilst said drawer is closed.

10. Drawer apparatus according to claim 6, wherein the said further locking means comprises an angularly movable handle mounted on the said one drawer front for use in changing the condition of the further locking means from operative to inoperative and for withdrawing the drawer in said other, opposite direction from a closed position.

11. Drawer apparatus accordingly to claim 8, wherein said further locking means includes a control member projecting from said one drawer front outwardly of the drawer such as to render the further locking means manually settable to either its operative or inoperative condition whilst said drawer is closed, and wherein said control member of the said further locking means comprises a lever pivoted intermediate its ends of which one projects outwardly of the drawer as aforesaid and, between said projecting end and the pivot, carries a latch for engagement (in the operative condition of the further locking means) with a stop member fast with a defining surface of the aperture.

12. Drawer apparatus according to claim 8, wherein said further locking means includes a control member projecting from said one drawer front outwardly of the drawer such as to render the further locking means manually settable to either its operative or inoperative condition whilst said drawer is closed, and wherein said control member of the further locking means comprises an angularly movable handle mounted on the outer surface of said one drawer front, the handle being operatively connected internally of the drawer and via a link member to a pivoted lever that carries a latch for engagement (in the operative condition of the further locking means) with a stop member fast with a defining surface of the aperture.

13. Drawer apparatus according to claim 6, wherein said further locking means is key-operable.

14. Drawer apparatus according to claim 10, wherein said angularly movable handle is lockable by a key.

15. Drawer apparatus according to claim 12, wherein said angularly movable handle is lockable by a key.

* * * * *